United States Patent [19]

Evanson

[11] 4,245,361

[45] Jan. 20, 1981

[54] WATER BED MATTRESS

[76] Inventor: Robert Evanson, S. 6102 Helena, Spokane, Wash. 99203

[21] Appl. No.: 88,578

[22] Filed: Oct. 26, 1979

[51] Int. Cl.[3] ..... A47C 27/08

[52] U.S. Cl. ..... 5/450; 5/451; 5/474

[58] Field of Search ..... 5/450, 451, 452, 449, 5/441, 474

[56] References Cited

U.S. PATENT DOCUMENTS

| | | | |
|---|---|---|---|
| 3,308,491 | 3/1967 | Spence . | |
| 3,456,270 | 7/1969 | Weinstein et al. | 5/451 |
| 3,574,873 | 4/1971 | Weinstein | 5/450 |
| 3,585,356 | 6/1971 | Hall | 5/450 |
| 3,600,726 | 8/1971 | Williams | 5/450 |
| 3,735,432 | 5/1973 | Kreten et al. | 5/451 |
| 3,787,907 | 1/1974 | Pennington et al. | 5/452 |
| 3,789,442 | 2/1974 | Tobinick | 5/451 |
| 3,840,921 | 10/1974 | Labianco | 5/451 |
| 4,006,501 | 2/1977 | Phillips | 5/452 |
| 4,015,299 | 4/1977 | Tinnel | 5/451 |
| 4,062,077 | 12/1977 | Autrey et al. | 5/451 |
| 4,192,031 | 3/1980 | Fogel | 5/451 |

OTHER PUBLICATIONS

*Bedding* Magazine, Aug. 1978, pp. 46–48, 21, 39, 58, 60.

*Primary Examiner*—Roy D. Frazier
*Assistant Examiner*—Alexander Grosz
*Attorney, Agent, or Firm*—Wells, St. John & Roberts

[57] ABSTRACT

A water bed mattress having a sealed liquid enclosure containing a relatively stiff peripheral cushion of foam plus a resilient open-cell filling within a central cavity.

9 Claims, 4 Drawing Figures

WATER BED MATTRESS

BACKGROUND OF THE INVENTION

The commercial evolution of water beds has moved from the original fluid filled bag surrounded by a rigid frame of wood to relatively complex hybrid structures which combine conventional mattress foundations and frames with a lighter weight "water bed mattress". Such a mattress typically is constructed in several pieces, including a supporting border of cushioned foam or other reinforcement materials, protective liners, covers and a smaller sealed bladder filled with water. The mattress also often includes heating elements and can also be provided with vibrator assemblies.

As water beds have become accepted by a greater segment of the population, more attention has been paid to one inherent property of a liquid-filled flexible container which has become both an asset and a liability in water bed design. This property is the tendency of the filled liquid bladder to transmit reflective wave motions across the mattress. This has been countered by the inclusion of various types of baffles within the bladders of both conventional water beds and hybrid structures. The baffles attempt to reduce wave motion while maintaining the desired body support peculiar to suspension upon the surface of a body of viscous liquid. The baffled construction is commonly termed a "waveless" water bed.

A recent development in "waveless" water bed construction is the inclusion of an open celled foam filling within the interior of the water bladder. The open cell foam essentially presents thousands of irregular "baffles" throughout the bladder to resist water movement or waves. An extremely soft foam material can be utilized, making the foam itself not discernable to the user and producing a resulting bladder having the feel of a simple liquid-filled flexible bag.

This foam-filled bladder provides significant improvement in eliminating wave motion. However, the foam filled liquid bladders for hybrid bed construction still require peripheral support, special covers and the other structural components and complexities which have been typically part of the design of hybrid water beds. The separate manufacture of these components, their separate handling from the manufacturer to the consumer, and the appearance of a complex bedding structure are all believed to detract from the cost efficiency and saleability of hybrid water beds.

The average consumer is familiar with the conventional mattress—a one piece element which is generally trouble-free during its normal life. The same appearance and unitary nature would enhance acceptance of a water bed. It is also highly desirable to package a water bed mattress in a weight and size configuration compatable with the dimensions of normal bedding materials, such as sheets, blankets and bed spreads. This increases the saleability of the product by permitting the mattress to be used with other bedding items either owned by or readily available to the consumer.

According to this invention, the design gap between the structure and appearance of a conventional mattress and the recognized shortcomings of a water bed mattress is filled by constructing the water bed mattress as a unitary sealed enclosure that incorporates a peripheral self-supporting rim of foam as well as a central cavity filled with open celled foam that acts as a wave baffle. Both the side structural elements of the mattress and the wave baffle structure are immersed in water or other suitable liquid. Only the unitary bladder structure containing these interior elements is required as the basic structure within a mattress assembly. It is comparable to the innerspring assembly or foam within a conventional mattress. The sealed enclosure can be incorporated within outer cushioned covers, or can be handled and packaged separately as a mattress sub-combination.

DESCRIPTION OF THE PREFERRED EMBODIMENTS

Figure 1:
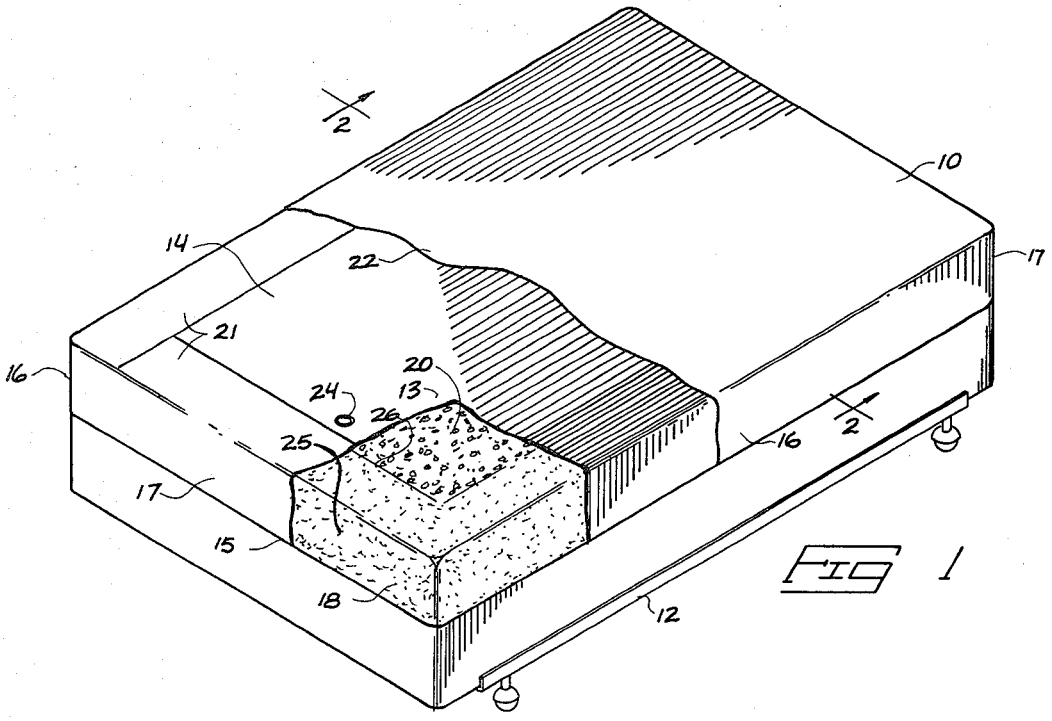
FIG. 1 is a perspective view of a bed incorporating the water bed mattress, with covering layers of the mattress structure being broken away.

FIG. 1 illustrates the invention as it applies to an improved form of a hybrid water bed. For definition purposes, a "hybrid water bed" refers to the combination of a relatively lightweight fluid-filled mattress structure together with a standard type of mattress foundation and bed frame. A hybrid water bed typically has an external appearance and size similar to those of a conventional bed assembly which includes an innerspring or foam mattress. The foundation for the mattress can be a spring foundation or a rigid frame. Either must be designed to support the additional weight of the fluid-filled mattress. Likewise, the bed frame 12 might be of conventional design, but made from heavier components than those required in a conventional bed structure.

The water bed mattress 10 is shown in FIG. 1 overlying a rectangular foundation 11 and supported by a bed frame 12. The structural details of the water bed mattress 10 are further illustrated in the sectional views presented in FIGS. 2, 3 and 4.

In all forms of the invention, the water bed mattress is encased within a sealed enclosure 13, which has outside dimensions identical to conventional mattress dimensions for a comparable bed size. The sealed flexible enclosure 13, which is commonly referred to as a "bladder", constitutes an envelope in which the water bed liquid is confined. A drain 24 of conventional design is provided in the enclosure 13 for filling and draining it. Any suitable flexible plastic material can be used in the construction of enclosure 13. The seams required to produce enclosure 13 can be produced by use of adhesives, mechanical joining procedures, or by using a combination of these, with or without the application of heat.

Enclosure 13 includes a horizontal upper wall 14 and a parallel horizontal lower wall 15 vertically spaced beneath it. Since the mattress 10 has a constant thickness, there is a constant vertical separation between the two horizontal walls 14, 15. A pair of vertical side walls 16 join the upper and lower walls 14, 15 at the respective sides thereof. Similarly, a pair of vertical end walls 17 join the walls 14, 15 at their respective ends and also join the side walls 16 at the corresponding ends of the side walls. The side walls 16 and end walls 17 cooperatively form conventional perpendicular corners about the periphery of the rectangular mattress 10.

Arranged within the confines of the sealed enclosure 13 is a peripheral cushion 18 that extends completely about the edges of the upper and lower enclosure walls 14, 15. The cushion 18 is preferably made from a self-supporting resilient foam material, such as high density polyurethane foam. Other relatively deformable materials might be used which have sufficient structural strength to be self-supporting and retain their shape, but have the ability to provide relatively deformable support about the peripheral edge of the mattress.

Cushion 18 assures comfortable contact by one sitting or lying upon it. It has upright outer surfaces 25 abutting the interiors of the respective side and end walls 16, 17. Cushion 18 has a constant height at the outer surface 25 which is equal to the vertical separation between the upper and lower walls 14, 15. It surrounds an interior cavity defined by upright inner surfaces 26, which are spaced from one another by a transverse distance across the side of mattress 10 and by a longitudinal distance across its ends.

Located within the cavity formed within the confines of the peripheral cushion 18 is an interior filling 20 of resilient open cell foam material, which again might be polyurethane foam. This open cell foam material is not provided for structural support, but to mechanically impede liquid movement. Where desired, its density can be selected for support of the user as well. It fills the remaining area of the interior cavity within the enclosure 13 not filled by the peripheral cushion 18. The side edges of the interior filling 20 abut the inner upright cushion surfaces 26. They can be attached about surfaces 26 or left unconnected. The resiliency of the interior filling 20 is preferably substantially greater than that of the peripheral cushion 18. For maximum water support effect, filling 20 should be so "soft" that it is not detectable by one lying or sitting upon the water bed mattress 10.

Figure 2:
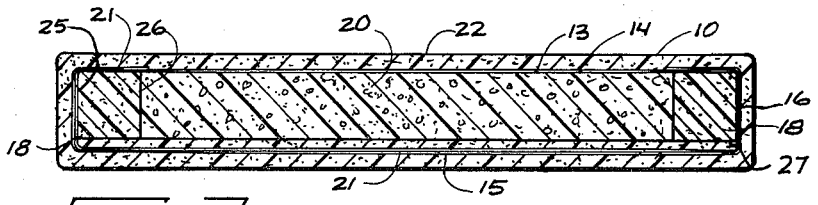
FIG. 2 is a transverse sectional view through the mattress as seen along line 2—2 in FIG. 1.

As shown in FIG. 2, the cushion 18 rests upon an attached sheet of foam material 27 which spans the fill inner width and length of enclosure 13. The sheet or layer of foam 27 is preferably made of high density polyurethane foam or other material similar to that used in peripheral cushion 18.

The lower sheet of foam material 27 serves as a structural locator for the spaced walls of peripheral cushion 18. It prevents the lower edges of cushion 18 from spreading outward and further prevents them from moving inward as well. The combination of the structural connection to sheet 27 plus the total confinement within enclosure 13 assures normal positioning of the rectangular peripheral cushion 18 without the requirement of any rigid elements inside or outside enclosure 13.

The interior filling 20 need not be secured to sheet 27. In many instances it might be desirable to leave filling 20 free to "float" vertically within the cavity. By making the height of filling 20 less than the height of the cavity containing it, the open-cell foam will remain against the upper wall 14 of enclosure 13 due to its flotation. This will assure effective baffling of wave movement at the top surface of the mattress and yet permit unrestricted vertical fluid support of the user's body resting upon it. In this instance, softer support is achieved by adding more liquid to the enclosure 13, and more rigid support will result from decreasing the liquid volume, which will permit filling 20 to settle downward toward sheet 27.

After the water bed mattress has been located at its site of use, it is fully filled with liquid material. Water or other liquid can be added or drained through the access provided at drain 24.

Figure 3:
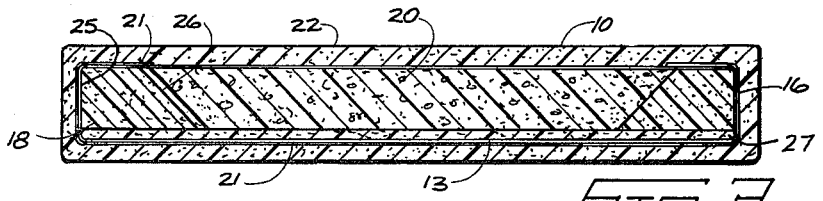
FIG. 3 is a sectional view similar to FIG. 2, showing a modified mattress form.

In FIG. 2, the inner surfaces 26 about cushion 18 are illustrated as being vertical and parallel to its outer surfaces 25. Likewise, the abutting edges of the interior filling 20 are vertical. In some instances, it might be more desirable to have the inner surfaces 26 inclined upwardly and outwardly from the lower wall 15 to the upper wall 14 of enclosure 13. This variation is illustrated in FIG. 3. Both design configurations are encompassed within this disclosure, as well as other available complementary surface shapes that might be used along the interface between the surfaces of peripheral cushion 18 and interior filling 20.

For safety purposes in the event of a leak occurring in the liquid filled enclosure 13, there can be provided an external liner 21 of vinyl or other suitable plastic sheet material. The liner is formed from a flat sheet, folded about the sides and ends of the enclosure 13 and having overlapping watertight seams. The side edges of liner 21 extend inwardly from the side and end walls 16, 17 to provide a flexible retainer capable of preventing water from escaping beyond the location of the enclosure 13.

Figure 4:
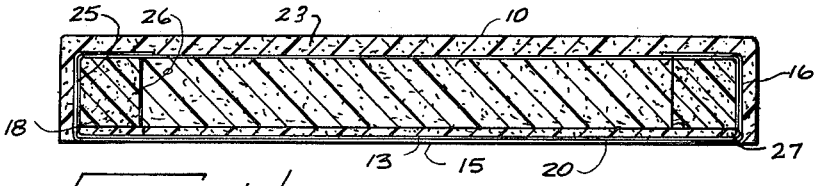
FIG. 4 is another sectional view similar to FIG. 2, illustrating a further modification.

The enclosure 13, with or without the described liner 21, can be partially or completely covered by a cushioned fabric cover. In FIGS. 2 and 3, the mattress covering 22 is shown fully enclosing the outside surfaces of the enclosures 13, thereby presenting the external appearance of a conventional innerspring or foam mattress. In FIG. 4, a partial cover 23 is illustrated, being fitted about the outside surfaces of the upper wall 14, and the side and end walls 16, 17. With this arrangement, the fitted cover 23 can be removed from the self-supporting enclosure 13 during usage of the water bed mattress. The removable fitted cover also eliminates the need to provide a movable flap in the mattress covering for access to drain 24.

The water bed mattress as described herein incorporates all of its structural features within a sealed liquid filled enclosure or bladder. Both the peripheral cushion 18 and the interior filling 20 are exposed to direct contact with the interior liquid. It is not necessary to maintain the integrity of any seams or dividers between them. More importantly, the integral enclosure 13 is capable of being completely enclosed by a mattress covering, thereby presenting a potential purchaser with a one piece unit. The integral nature of the mattress has an appearance more familiar to the average customer and, prior to being filled with liquid, closely approximates the size, shape and weight of a conventional mattress. It can be delivered and set up without any special knowledge or working precautions.

Since all of the supporting components for the mattress are located within the enclosure, they are not externally exposed or subjected to possible damage or injury. The mattress incorporates the wave-controlling features of the filling of open cell foam together with the structural support of the peripheral cushion. The enclosure walls tie the cushion and filling together as a structural unit, while also confining the liquid that is in contact with both the cushion and filling.

Modifications can be made in this structure, while maintaining the basic component relationship discussed above.

Having described my invention, I claim:

1. A water bed mattress, comprising:

sealed plastic liquid enclosure means for holding a quantity of liquid, said enclosure means including:

a horizontal upper wall;

a horizontal lower wall beneath said upper wall;

a pair of vertical side walls joining the upper and lower walls at opposite sides thereof;

a pair of vertical end walls joining the upper and lower walls at opposite ends thereof and joining the side walls at corresponding ends thereof;

a peripheral cushion of self-supporting resilient foam material arranged as an interior border within the enclosure, the peripheral cushion having upright outer surfaces in abutment with the interiors of the respective vertical side and end walls, said peripheral cushion having a constant height at its upright outer surfaces equal to the vertical separation between said upper and lower walls and surrounding an interior cavity defined by upright inner surfaces spaced from one another;

an interior filling of resilient open cell foam material filling the area of the interior cavity within the enclosure and abutting the inner upright cushion surface; the resiliency of the interior filling being substantially greater than that of the peripheral cushion;

said enclosure adapted to be fully filled with liquid material.

2. A water bed mattress as set out in claim 1 wherein the upright inner surfaces of the peripheral cushion are vertical and parallel to its upright outer surfaces.

3. A water bed mattress as set out in claim 1 wherein the upright inner surfaces of the peripheral cushion are upwardly and outwardly inclined from a lower edge abutting the interior of the horizontal lower wall to an upper edge abutting the interior of the horizontal upper wall.

4. A water bed mattress as set out in claim 1 wherein the peripheral cushion is constructed of closed cell foam.

5. A water bed mattress as set out in claim 1 wherein the peripheral cushion is constructed of open cell foam.

6. A water bed mattress as set out in claim 1 further comprising:

a padded cover complementary to the shape and size of said liquid enclosure, said cover being fitted about the outside surface of the upper wall, side walls and end walls.

7. A water bed mattress as set out in claim 1 further comprising:

a padded fabric covering fully enclosing the outside surfaces of the enclosure and having the external appearance of a conventional mattress.

8. A water bed mattress as set out in claim 1 further comprising:

a liquid impervious liner having an integral sealed configuration overlapping the outside surfaces of the enclosure lower wall, its side and end walls and fitted over a peripheral border about the outside surface of its upper wall.

9. A water bed mattress as set out in claim 1 further comprising:

a sheet of foam material joined across the bottom of said peripheral cushion and located within the enclosure.

* * * * *